US007042403B2

(12) United States Patent
Colburn et al.

(10) Patent No.: US 7,042,403 B2
(45) Date of Patent: May 9, 2006

(54) DUAL BAND, LOW PROFILE OMNIDIRECTIONAL ANTENNA

(75) Inventors: Joseph S. Colburn, Los Angeles, CA (US); Daniel F. Sievenpiper, Los Angeles, CA (US)

(73) Assignee: General Motors Corporation, Detroit, MI (US)

( * ) Notice: Subject to any disclaimer, the term of this patent is extended or adjusted under 35 U.S.C. 154(b) by 106 days.

(21) Appl. No.: 10/764,014

(22) Filed: Jan. 23, 2004

(65) Prior Publication Data

US 2005/0162321 A1 Jul. 28, 2005

(51) Int. Cl.
*H01Q 1/24* (2006.01)
*H01Q 1/48* (2006.01)

(52) U.S. Cl. ..... 343/702; 343/846

(58) Field of Classification Search ..... 343/700 MS, 343/702, 846

See application file for complete search history.

(56) References Cited

U.S. PATENT DOCUMENTS 4,040,060 A * 8/1977 Kaloi ..... 343/700 MS
4,151,531 A * 4/1979 Kaloi ..... 343/700 MS
4,155,089 A * 5/1979 Kaloi ..... 343/700 MS
6,049,314 A * 4/2000 Munson et al. ..... 343/846
6,160,515 A * 12/2000 McCoy et al. ..... 343/702

(Continued)

OTHER PUBLICATIONS

Ch. Delaveaud, Ph. Leveque and B. Jecko, "New kind of microstrip antenna: the monopolar wire-patch antenna", Electronics Letters; Jan. 6, 1994, vol. 30, No. 1, pp. 1-2.
Lee/Hall/Gardner, "Compact dual-band dual-polarisation microstrip patch antenna", Electronics Letters Jun. 24, 1999, vol. 35, No. 13, pp. 10341-1036.

(Continued)

*Primary Examiner*—Hoang V. Nguyen
*Assistant Examiner*—Hung Tran Vy
(74) *Attorney, Agent, or Firm*—Laura C. Hargitt

(57) ABSTRACT

A low-profile dual-band antenna includes a ground plane. An "E"-shaped metal plate is located a first distance from the ground plane and includes first and second outer extensions and an inner extension of the metal plate. A feed tab connects the inner extension and the ground plane. A shorting tab connects the inner extension and the ground plane. The low-profile dual-band antenna communicates first radio frequency (RF) signals in a first RF band and second RF signals in a second RF band. The first RF signals and the second RF signals are vertical polarized signals. The low-profile dual-band antenna produces a radiation pattern that is omnidirectional in the azimuth plane and vertically polarized in a horizontal plane when communicating the first RF signals and the second RF signals. The first RF band and the second RF band can be independently tuned.

22 Claims, 6 Drawing Sheets

U.S. PATENT DOCUMENTS

| | | | | |
|---|---|---|---|---|
| 6,218,990 | B1 * | 4/2001 | Grangeat et al. | 343/700 MS |
| 6,864,842 | B1 * | 3/2002 | Hung et al. | 343/700 MS |
| 6,433,742 | B1 * | 8/2002 | Crawford | 343/700 MS |
| 6,650,296 | B1 * | 11/2003 | Wong et al. | 343/700 MS |
| 6,861,990 | B1 * | 3/2005 | Hung et al. | 343/702 |
| 2002/0003499 | A1 * | 1/2002 | Kouam et al. | 343/700 MS |
| 2004/0196191 | A1 * | 10/2004 | Hung et al. | 343/700 MS |
| 2004/0212535 | A1 * | 10/2004 | Tang et al. | 343/700 MS |
| 2004/0233110 | A1 * | 11/2004 | Hung et al. | 343/700 MS |

OTHER PUBLICATIONS

Liu/Hall/Wake, "Dual-Frequency Planar Inverted-F Antenna", IEEE Transactions on Antennas and Propagation, vol. 45, No. 10, Oct. 1997, pp. 14511458.

Yang/Zhang/Ye/Rahmat-Samii, "Wide-Band E-Shaped Patch Antennas for Wireless Communications", IEEE Transactions on Antennas and Propagation, vol. 49, No. 7, Jul. 2001, pp. 1094-1100.

* cited by examiner

DUAL BAND, LOW PROFILE OMNIDIRECTIONAL ANTENNA

FIELD OF THE INVENTION

The present invention relates to low-profile antennas, and more particularly to dual-band low-profile antennas.

BACKGROUND OF THE INVENTION

Various vehicle systems may require an antenna for mobile phones, satellite radio, terrestrial radio, and/or global positioning systems. Providing several antennas on a vehicle is costly and aesthetically displeasing. The antennas are preferably low profile and small in size.

Most Terrestrial communications systems require the transmission and/or reception of vertical polarized signals. Terrestrial communications systems may require reception and transmission of radio frequency (RF) signals in multiple bands. For example, vehicle systems such as mobile phones and remote assistance services transmit and/or receive vertical polarized signals in multiple bands.

Mobile phone and remote assistance services typically require communication in both the Advanced Mobile Phone System (AMPS) and the Personal Communications Services (PCS) bands. A dual band antenna that communicates in both the AMPS (824 to 894 MHz) and PCS (1.85 to 1.99 GHz) bands requires a large frequency separation.

In one method, a patch antenna is used for dual band communication. However, the patch antenna transmits/receives most of its energy perpendicular to the plane of the patch antenna, which is not suitable for terrestrial communications. Additionally, patch antennas are large in size, which is costly and aesthetically displeasing.

In another method, a Planar Inverted-F Antenna (PIFA) is used for dual band communication. While the dual band PIFA transmits/receives vertical polarized signals at both frequencies, the separation between the available frequencies is not suitable for communication in both the AMPS and PCS bands.

SUMMARY OF THE INVENTION

A low-profile dual-band antenna according to the present invention includes a ground plane. An "E"-shaped metal plate is located a first distance from the ground plane and includes first and second outer extensions and an inner extension of the metal plate. A feed tab connects the inner extension and the ground plane. A shorting tab connects the inner extension and the ground plane. The low-profile dual-band antenna communicates first radio frequency (RF) signals in a first RF band and second RF signals in a second RF band.

In other features, the first RF signals and the second RF signals are vertical polarized signals. The low-profile dual-band antenna produces a radiation pattern that is omnidirectional in the azimuth plane and vertically polarized in a horizontal plane when communicating the first RF signals and the second RF signals.

In still other features of the invention, the first RF band and the second RF band can be independently tuned. The first RF band is an Advanced Mobile Phone System (AMPS) band. The second RF band is a Personal Communications Services (PCS) band. A length of the first and second outer extensions determines a first resonant frequency of the low-profile dual-band antenna. A length of the inner extension determines a second resonant frequency of the low-profile dual-band antenna.

In yet other features, the low-profile dual-band antenna is fed by a cable with a first conductor and a second conductor, the first conductor connects to the inner extension, and the second conductor connects to the ground plane. The cable excites the metal plate with respect to the ground plane to transmit vertical polarized signals. The low-profile dual-band antenna operates in a mobile phone system.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
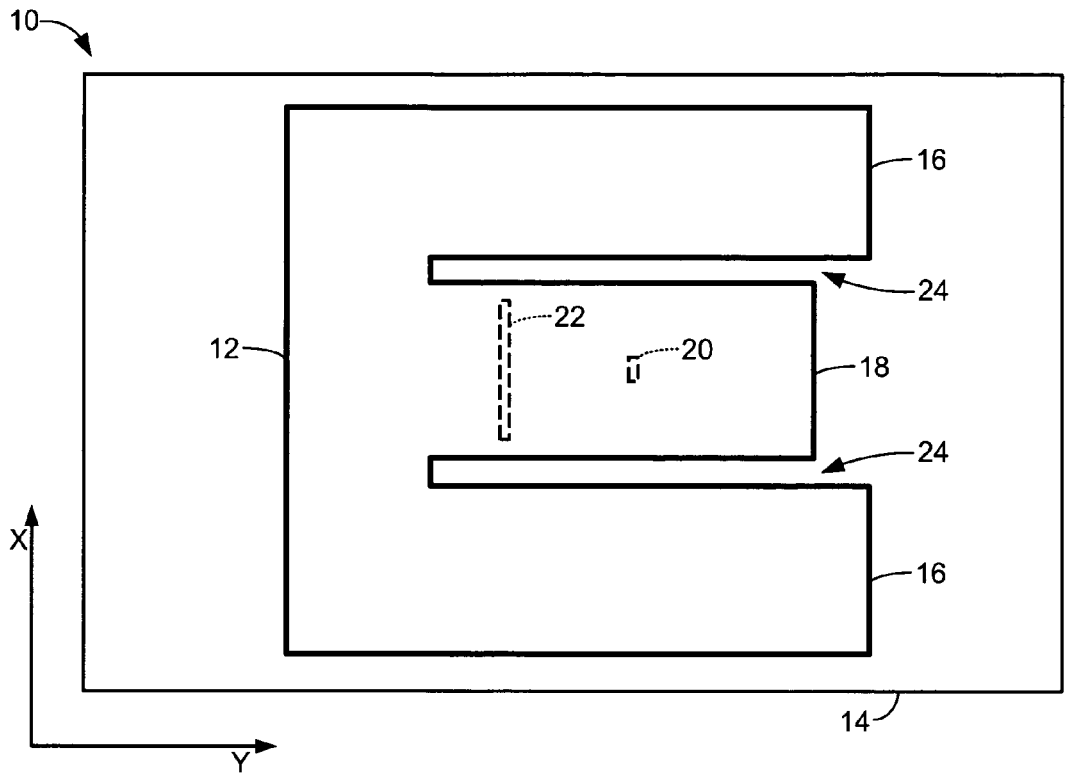
FIG. 1 is a plan view of a low profile dual band antenna according to the present invention.

The following description of the preferred embodiment(s) is merely exemplary in nature and is in no way intended to limit the invention, its application, or uses. For purposes of clarity, the same reference numbers will be used in the drawings to identify similar elements.

Figure 2:
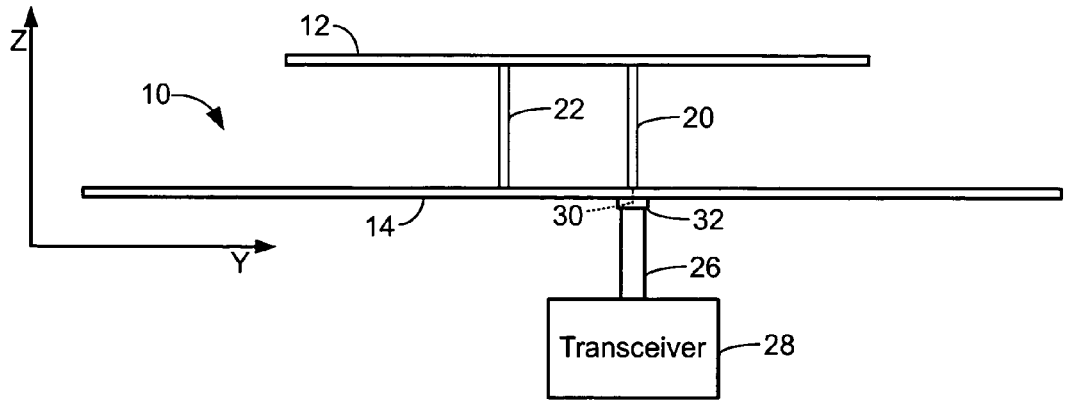
FIG. 2 is a profile view of the antenna in FIG. 1.

Referring to FIGS. 1 and 2, an antenna 10 includes a metal plate 12 that is located a first distance from a ground plane 14. The metal plate 12 is E-shaped and includes first and second outer extensions 16 and an inner extension 18. A feed tab 20 and a shorting tab 22 are connected between the inner extension 18 and the ground plane 14.

The antenna 10 is a combination of an inductively loaded center fed patch antenna and a Planar Inverted-F Antenna (PIFA). Center fed patch antennas typically include a feed tab located in the center of a metal plate. Center fed patch antennas are inductively loaded by positioning two shorting tabs on each side of a feed tab. For example, an article by C. Delaveaud, P. Leveque, and B. Jecko, "New Kind of Microstrip Antenna: The Monopolar Wire-patch Antenna", in *Electronics Letters,* Vol. 30, No. 1, which is hereby incorporated by reference, describes an inductively loaded center fed patch antenna.

The structure of the antenna 10 of the present invention is accomplished by removing one of the shorting tabs of a center fed patch antenna and centering the remaining shorting tab and feed tab on the metal plate 12. The shorting tab 22 allows the antenna 10 to be smaller than typical patch antennas.

Two parallel slots 24 are formed in the metal plate 12. The parallel slots 24 are perpendicular to the shorting tab 22 and are located on each side of the shorting tab 22 and the feed tab 20. The parallel slots 24 define the first and second outer extensions 16 and the inner extension 18 of the metal plate 12.

By introducing the parallel slots 24, the inner extension 18 of the metal plate 12 visually resembles and functions as a PIFA. Additionally, the antenna 10 is capable of functioning as a typical center fed patch antenna without being adversely affected by the parallel slots 24. Therefore, the antenna 10 has two resonant frequencies.

The two resonant frequencies of the antenna 10 may be independently tuned. A length of the first and second outer extensions 16 (the overall length of the metal plate 12) determines the first resonant frequency of the antenna 10, which is similar to a resonant frequency of a center fed patch antenna. A length of the inner extension 18 determines the second resonant frequency of the antenna 10, which is similar to a resonant frequency of a PIFA. Each of the resonant frequencies of the antenna 10 may be independently tuned without adversely affecting the other.

The antenna 10 is fed by a cable 26 connected to a transceiver 28. The cable 26 includes a first conductor 30 and a second conductor 32. For example, the cable 26 may be a coaxial cable. The first conductor 30 is connected to the feed tab 20, and the second conductor 32 is connected to the ground plane 14. The cable 26 excites the metal plate 12 with respect to the ground plane 14 to transmit/receive Radio Frequency (RF) signals. Since the antenna 10 functions as a center fed patch antenna as well as a PIFA, the antenna 10 transmits/receives vertical polarized signals at both resonant frequencies. Vertical polarized signals are ideal for terrestrial communications. The radiation pattern of the antenna 10 is predominantly omnidirectional in the azimuth plane and vertically polarized in a horizontal plane at both resonant frequencies.

The first resonant frequency of the antenna 10 is ideal for the transmission/reception of RF signals in the Advanced Mobile Phone System (AMPS) band. The second resonant frequency of the antenna 10 is ideal for the transmission/reception of RF signals in the Personal Communications Services (PCS) band. Vehicle systems such as mobile phones and remote assistance services require communication in both the AMPS and PCS bands.

Figure 3:
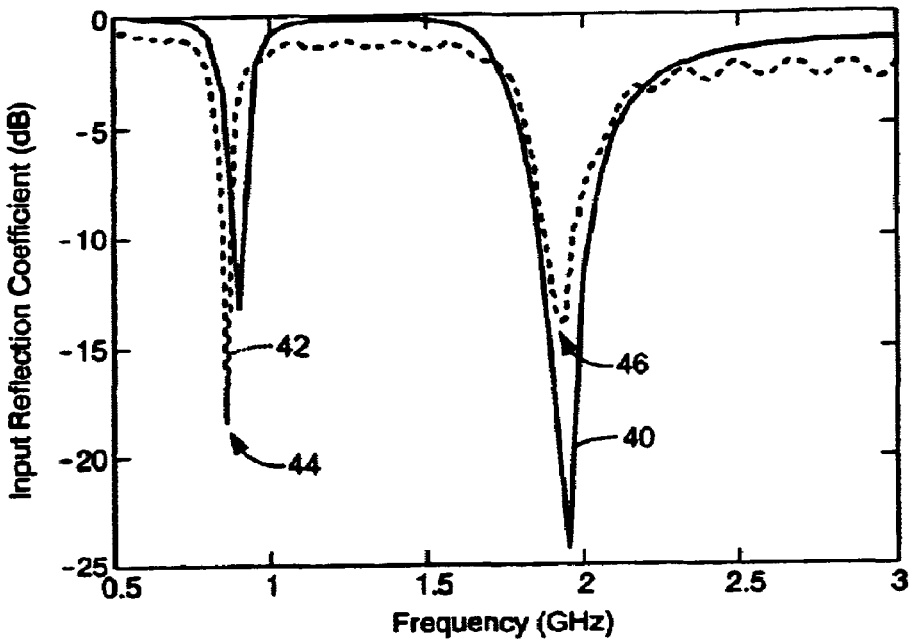
FIG. 3 is a graph showing the input reflection coefficient of the antenna as a function of frequency.

Referring now to FIG. 3, the resonant frequencies of an exemplary antenna according to the present invention are illustrated. Simulated results are indicated at 40, and measured results are indicated at 42. The simulated and measured results 40 and 42, respectively, are comparable. FIG. 3 shows two distinct resonances. The first resonant frequency, indicated at 44, is approximately 900 MHz, which is ideal for communication in the AMPS band. The second resonant frequency, indicated at 46, is approximately 1.9 GHz, which is in the PCS band. The measured results 42 in FIG. 3 were recorded using a prototype of the antenna 10. The overall length of the metal plate 12 for the prototype was 65 mm. Additionally, the inner extension 18 measured 43 mm. However, other dimensions may be used.

Referring now to FIGS. 4A–5C, the simulated gain of the antenna 10 is shown at 900 MHz (FIGS. 4A–4C) and 1.9 GHz (FIGS. 5A–5C) in three principle planes. The planes are the X-Z plane, the Y-Z plane, and the X-Y plane, respectively. The X-Y plane is parallel to the ground plane 14 and the metal plate 12. The X-Z plane is perpendicular to the feed tab 20 and the parallel slots 24. The Y-Z plane is parallel to the feed tab 20 and the parallel slots 24.

Phi angles indicate the angle of rotation around the Z-axis measured from the X-axis. Theta angles indicate the angle of rotation from the Z-axis. For example, when theta equals 90 degrees, the radiation pattern in the horizontal plane is illustrated. Theta of 0 degrees is a direction perpendicular to the surface of the ground plane 14. Solid lines represent the level of the vertical polarization strength, and dashed lines represent the level of the horizontal polarization strength. The outer radius of the plots is 5 dB, and the scale is 5 dB per division.

Figure 4A:
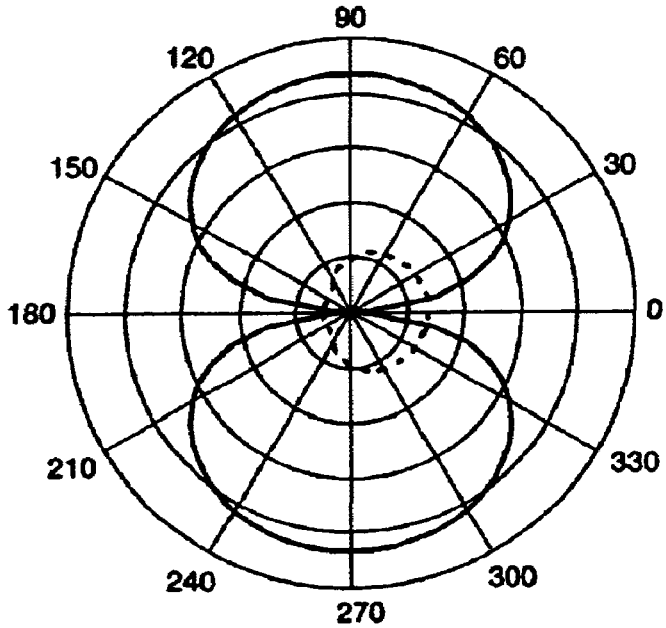
FIG. 4A is a plot illustrating the radiation pattern of the antenna in a first vertical plane while communicating in the AMPS band.
Figure 4B:
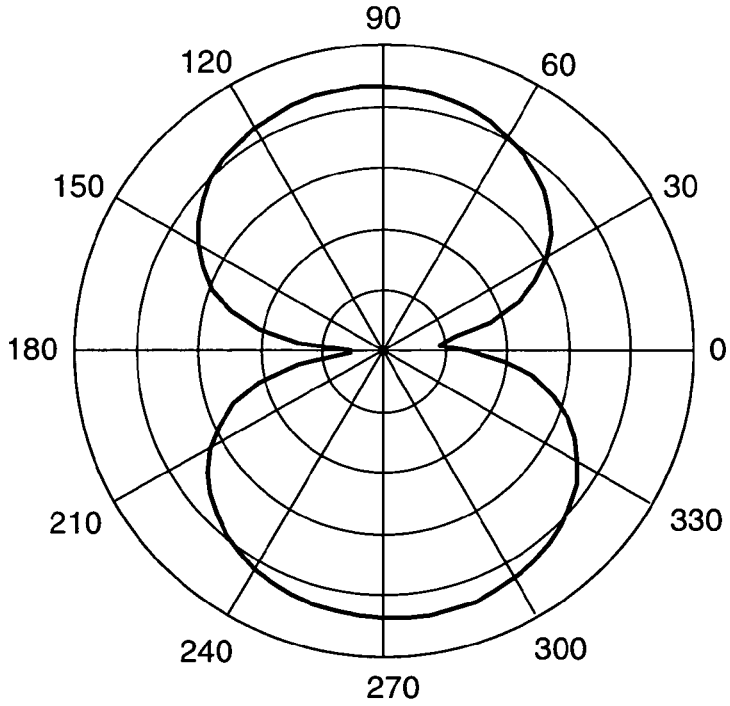
FIG. 4B is a plot illustrating the radiation pattern of the antenna in a second vertical plane while communicating in the AMPS band.
Figure 4C:
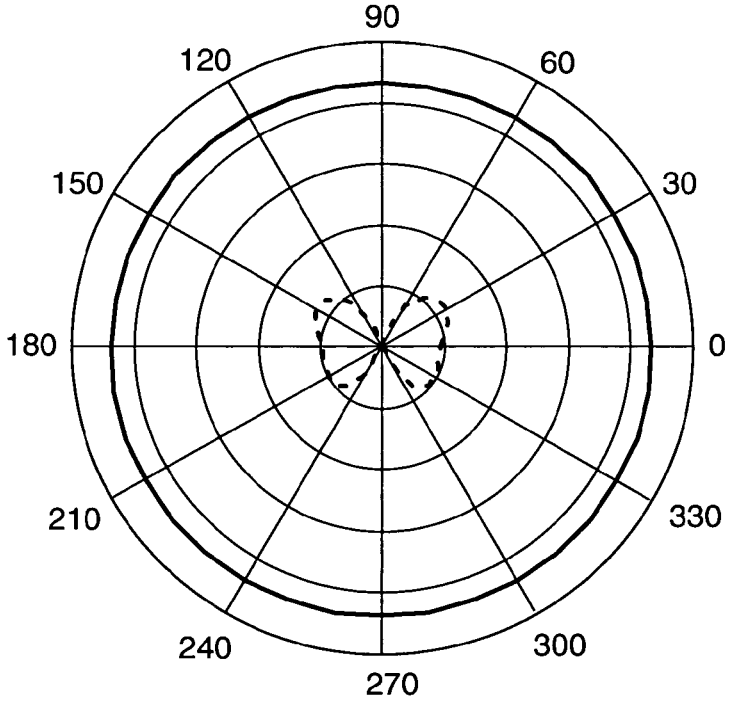
FIG. 4C is a plot illustrating the radiation pattern of the antenna in a horizontal plane while communicating in the AMPS band.

FIG. 4A shows the radiation pattern in a phi cut of 0 degrees, and FIG. 4B shows the radiation pattern in a phi cut of 90 degrees at 900 MHz. In FIGS. 4A and 4B, the radiation pattern is maximum toward the horizon and null toward zenith, which is ideal for terrestrial communications. The radiation pattern is similar to that of a monopole antenna. FIG. 4C shows the radiation pattern when theta is equal to 90 degrees. The radiation pattern is omnidirectional in the horizontal plane.

Figure 5A:
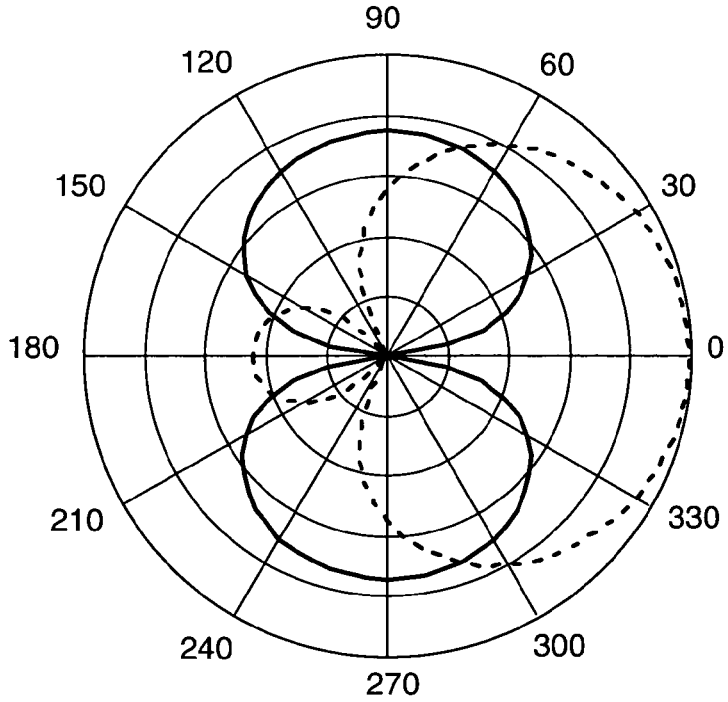
FIG. 5A is a plot illustrating the radiation pattern of the antenna in a first vertical plane while communicating in the PCS band.
Figure 5B:
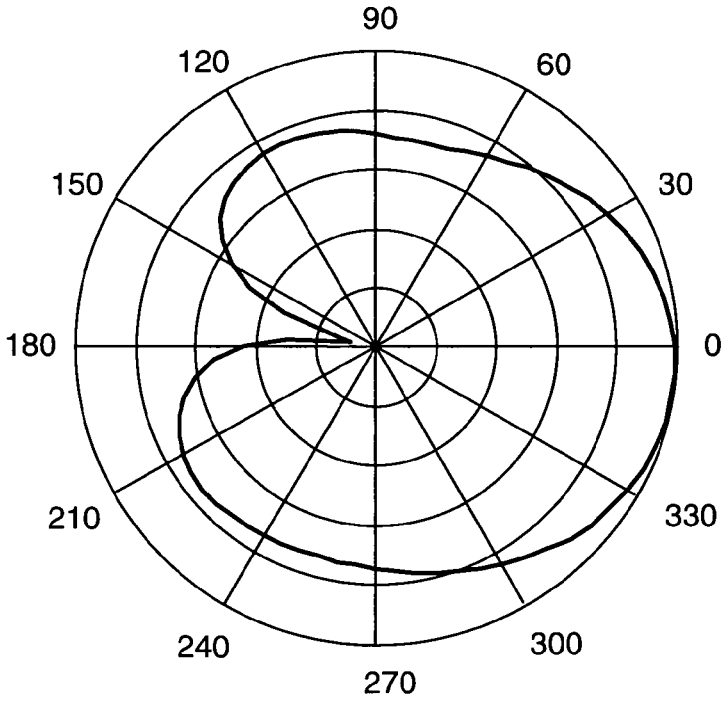
FIG. 5B is a plot illustrating the radiation pattern of the antenna in a second vertical plane while communicating in the PCS band.
Figure 5C:
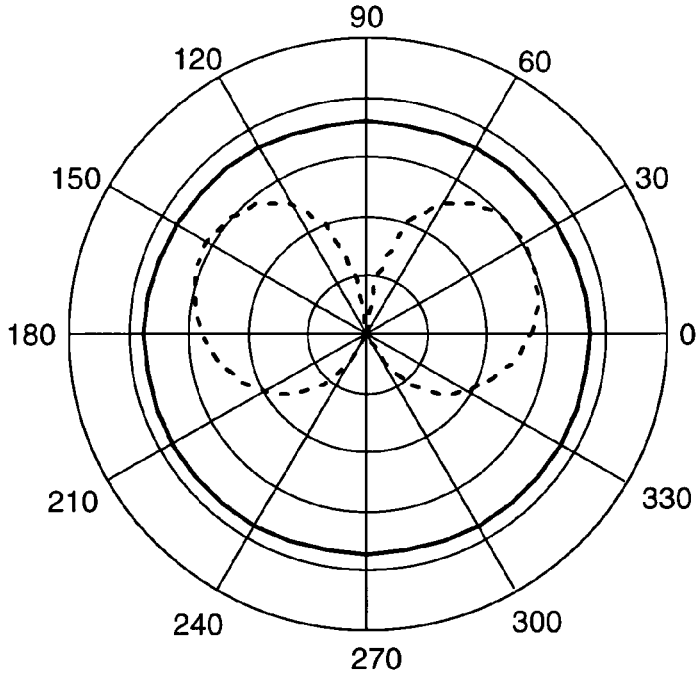
FIG. 5C is a plot illustrating the radiation pattern of the antenna in a horizontal plane while communicating in the PCS band.

FIG. 5A shows the radiation pattern in a phi cut of 0 degrees, and FIG. 5B shows the radiation pattern in a phi cut of 90 degrees at 1.9 GHz. The radiation pattern is typical of a PIFA and is abundant towards the horizon. FIG. 5C shows the radiation pattern with theta equal to 90 degrees. As in FIG. 4C, the radiation pattern is omnidirectional in the horizontal plane.

FIGS. 4A–5C illustrate the operation of the antenna 10 as a center fed patch antenna at the first resonant frequency and as a PIFA at the second resonant frequency. The characteristics of the radiation pattern meet the needs of typical terrestrial communications systems that require the transmission/reception of vertically polarized signals that are omnidirectional in the horizontal plane.

Figure 6:
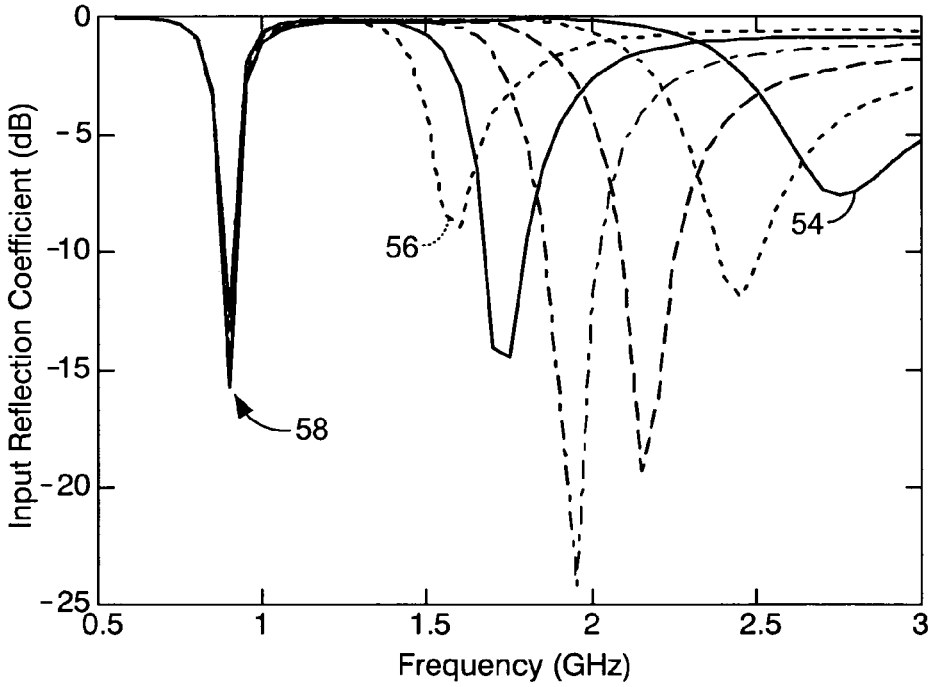
FIG. 6 is a graph showing the input reflection coefficient of the antenna as a function of frequency while a length of the inner extension of the antenna is varied.

Referring now to FIG. 6, the stability of the first resonant frequency is illustrated while a length of the inner extension 18 is varied. For the prototype of the antenna 10, the length of the inner extension 18 is varied from 28 mm, indicated at 54, to 53 mm, indicated at 56. FIG. 6 shows that varying the length of the inner extension 18, and thus the second resonant frequency, has little or no effect on the first resonant frequency, which is indicated at 58. The second resonant frequency varied from 2.75 GHz when the inner extension 18 measured 28 mm, to 1.6 GHz when the inner extension 18 measured 53 mm.

Figure 7:
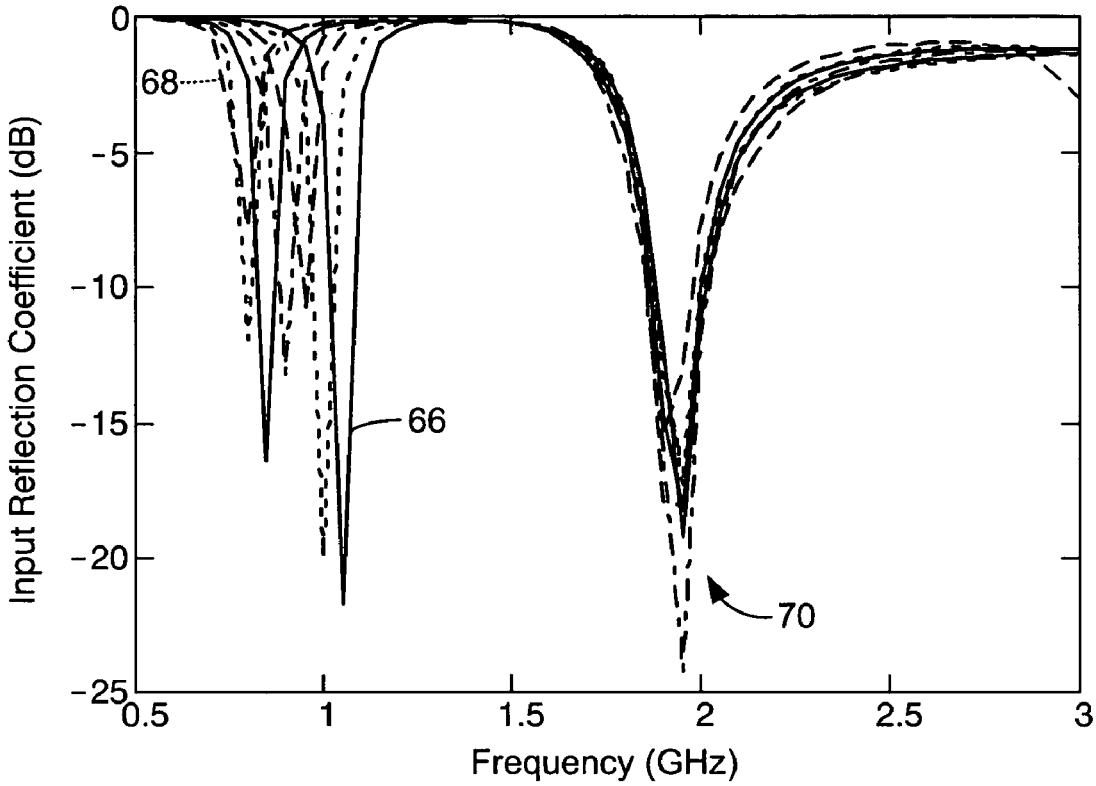
FIG. 7 is a graph showing the input reflection coefficient of the antenna as a function of frequency while a length of the first and second outer extensions of the antenna is varied.

Referring now to FIG. 7, the stability of the second resonant frequency is illustrated while an overall length of the metal plate 12 (determined by a length of the first and second outer extensions 16) is varied. For the prototype of the antenna 10, the overall length of the metal plate 12 is varied from 35.5 mm, indicated at 66, to 95 mm, indicated at 68. FIG. 7 shows that varying the overall length of the metal plate 12, and thus the first resonant frequency, has little or no effect on the second resonant frequency, which is indicated at 70. The first resonant frequency varied from 1.05 GHz when the overall length of the metal plate 12 measured 35.5 mm, to 800 MHz when the overall length of the metal plate 12 measured 95 mm.

The antenna 10 of the present invention is dual band, omnidirectional, and ideal for applications in wireless communications products that require vertical polarization at both resonant frequencies. The antenna 10 is particularly applicable to vehicular mobile phone and remote assistance services that require low profile antennas on vehicles capable of providing coverage in both the AMPS and PCS bands.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, specification, and the following claims.

What is claimed is:

1. A low-profile dual-band antenna, comprising:

a ground plane;

an "E"-shaped metal plate that is located a first distance from said ground plane and that includes first and second outer extensions and an inner extension of said metal plate;

a feed tab that connects said inner extension and said ground plane; and a shorting tab that connects said inner extension and said ground plane;

wherein said low-profile dual-band antenna communicates first radio frequency (RF) signals in a first RF band and second RF signals in a second RF band.

2. The low-profile dual-band antenna of claim 1 wherein said first RF signals and said second RF signals are vertical polarized signals.

3. The low-profile dual-band antenna of claim 1 wherein said low-profile dual-band antenna produces a radiation pattern that is omnidirectional in the azimuth plane and vertically polarized in a horizontal plane when communicating said first RF signals and said second RF signals.

4. The low-profile dual-band antenna of claim 1 wherein said first RF band and said second RF band can be independently tuned.

5. The low-profile dual-band antenna of claim 4 wherein said first RF band is an Advanced Mobile Phone System (AMPS) band.

6. The low-profile dual-band antenna of claim 4 wherein said second RF band is a Personal Communications Services (PCS) band.

7. The low-profile dual-band antenna of claim 4 wherein a length of said first and second outer extensions determines a first resonant frequency of said low-profile dual-band antenna.

8. The low-profile dual-band antenna of claim 4 wherein a length of said inner extension determines a second resonant frequency of said low-profile dual-band antenna.

9. The low-profile dual-band antenna of claim 1 wherein said low-profile dual-band antenna is fed by a cable with a first conductor and a second conductor, said first conductor connects to said inner extension, and said second conductor connects to said ground plane.

10. The low-profile dual-band antenna of claim 9 wherein said cable excites said metal plate with respect to said ground plane to transmit vertical polarized signals.

11. The low-profile dual-band antenna of claim 1 wherein said low-profile dual-band antenna operates in a mobile phone system.

12. A method for producing a low-profile dual-band antenna, comprising:

forming first and second parallel slots in a metal plate, wherein said first and second parallel slots are symmetrically disposed about a center point of said metal plate and produce first and second outer extensions and an inner extension of said metal plate;

providing a ground plane;

connecting a first end of a feed tab to said inner extension and a second end of said feed tab to said ground plane;

connecting a first end of a shorting tab to said inner extension and a second end of said shorting tab to said ground plane;

wherein said low-profile dual-band antenna communicates first radio frequency (RF) signals in a first RF band and second RF signals in a second RF band.

13. The method of claim 12 wherein said first RF signals and said second RF signals are vertical polarized signals.

14. The method of claim 12 wherein said low-profile dual-band antenna produces a radiation pattern that is omnidirectional in the azimuth plane and vertically polarized in a horizontal plane when communicating said first RF signals and said second RF signals.

15. The method of claim 12 further comprising:

independently tuning said first RF band and said second RF band.

16. The method of claim 15 wherein said first RF band is an advanced mobile phone system (AMPS) band.

17. The method of claim 15 wherein said second RF band is a personal communications services (PCS) band.

18. The method of claim 16 further comprising:

adjusting a length of said first and second outer extensions to tune a first resonant frequency of said low-profile dual-band antenna.

19. The method of claim 17 further comprising:

adjusting a length of said inner extension to tune a second resonant frequency of said low-profile dual-band antenna.

20. The method of claim 12 further comprising:

connecting a first conductor of a feed cable to said inner extension; and connecting a second conductor of said feed cable to said ground plane.

21. The method of claim 20 further comprising:

exciting said metal plate with respect to said ground plane using said feed cable to communicate vertical polarized signals.

22. The method of claim 12 wherein said low-profile dual-band antenna operates in a mobile phone system.

* * * * *